United States Patent [19]

Toguchi et al.

[11] Patent Number: 4,866,227

[45] Date of Patent: Sep. 12, 1989

[54] SEALED CONTACT DEVICE

[75] Inventors: Takehiko Toguchi; Mamoru Tateno; Kiwamu Shibata; Hiromichi Inoue, all of Kadoma, Japan

[73] Assignee: Matsushita Electric Works, Ltd., Osaka, Japan

[21] Appl. No.: 191,970

[22] Filed: May 9, 1988

[30] Foreign Application Priority Data

May 25, 1987 [JP] Japan ..... 62-129184
Mar. 9, 1988 [JP] Japan ..... 63-55716

[51] Int. Cl.[4] ..... H01H 33/18

[52] U.S. Cl. ..... 200/147 A; 200/148 B; 200/148 G; 200/144 B

[58] Field of Search ..... 200/147 A, 147 R, 148 B, 200/148 G, 144 B

[56] References Cited

U.S. PATENT DOCUMENTS

| | | | |
|---|---|---|---|
| 3,431,377 | 3/1969 | Barlow et al. | 200/144 R |
| 3,831,118 | 8/1974 | Bitko | 200/144 R |
| 4,816,624 | 3/1989 | Perrissin | 200/147 A |

*Primary Examiner*—Robert S. Macon
*Attorney, Agent, or Firm*—Burns, Doane, Swecker & Mathis

[57] ABSTRACT

A sealed contact device is formed by disposing a fixed electrode having a fixed contact in an air-tight space defined in a hermetical container in which an electrically insulating gas is sealed at a high pressure, a movable contact of a movable electrode is provided for contact opening and closing with the fixed contact, and means is provided with respect to the movable electrode for allowing it positively movable in the air-tight manner, whereby an optimum contact opening speed of the movable contact and at the same time a proper contact pressure are both obtainable.

11 Claims, 5 Drawing Sheets

SEALED CONTACT DEVICE

TECHNICAL BACKGROUND OF THE INVENTION:

This invention relates to sealed contact devices and, more particularly, to a device in which a fixed electrode having a fixed contact is disposed in a hermetical container of an electrically insulative gas and a movable contact of movable electrode is provided for moving toward and away from the fixed contact to make the contacts ON and OFF.

Such sealed contact devices of the kind referred to can be optimumly employed in such power loading switching devices as electromagnetic switches, relays and the like.

DISCLOSURE OF PRIOR ART:

Generally, the switching devices may be classified, from view point of their current breaking region, into those for use with very weak current below 1A (so-called dry circuits), those for use in controlling resistance load of about 1 to 5A, those for use in a power load of about 5 to 30A, that is, small capacity inductive load, and those for use with middle and large capacity or any specific loads. In these switching devices, the one in the power load has been in the largest demand, but there have been still involving such various problems in the durability and reliability that arcs generated upon switching operations cause the contacts welded together so as to be large in the consumption, transfer and the like of the contacts.

In the above connection, an improvement in arc resistance properties has been considered effective to render the device highly durable and thus its life of use prolonged, and an example of this improvement attempted would be seen in such mercury relays as have been suggested in U.S. Pat. No. 3,431,377 to Marlcolm Barlow et al and U.S. Pat. No. 3,831,118 to Sheldon S. Bitko. In these relays, there has been employed an arrangement in which the contacts are moistened by means of mercury supplied due to the capillarity so as to achieve a contact stability, or an arrangement in which an arc suppression ability is improved by a utilization of cooling force of a high purity hydrogen gas sealed in at 200 to 250 PSi. With these mercury relays the arc resistance property can be improved to achieve the longer life but, once the switching current exceeds 5A, it increases evaporation amount of mercury upon switching on and off of the contacts so as to cause the mercury supply to the contacts insufficient. Accordingly, there still has been a problem that, when the particular mercury relay is employed in the switching device for the power loading of the current breaking region of about 5 to 30A, the contact consumption or welding is likely to take place to render the life remarkably shortened.

In attempt to remove the foregoing problem, the present inventors have earlier suggested in Japanese Patent Application Laid-Open Publication No. 61-78016 a sealed contact device, in which such an electrically insulative gas as hydrogen gas is sealed in a hermetical container at a high pressure, a pair of contacts are provided in the hermetical container for switching on and off therein, and a permanent magnet is mounted to the exterior of the container for providing a magnetic drive force to an arc generated inside the container upon the switching on and off of the contacts. With this sealed contact device, the arc thus generated is quickly cooled to be suppressed, and the device is made excellent in the arc resistance properties. According to the above laid-open publication, however, the arc suppressing force can be sufficiently improved, whereas a separating force of the both contacts upon contact opening operation has to be relied on the hydrogen pressure sealed in the container so that the separating force will have to be varied under the influence of variation with time elapsed and that in ambient temperature, and the contact switching operation is thereby caused to be unstable. As a result, there has been a problem unsolved in that decreased contact separating speed causes arc retaining time increased to render the contact consumption, or excessively increased contact opening force of the contacts, they cannot be closed completely so as to render the contact resistance enlarged.

FIELD OF ART:

A primary object of the present invention is, therefore, to provide a sealed contact device in which the switching contacts can stably operated within the hermetical container, and an optimum contact opening speed can be attained while a proper contact pressure can be achieved. According to the present invention, the above object can be realized by providing a sealed contact device in which an electrically insulative gas is sealed in n air-tight space defined in a hermetical container, a fixed contact is provided to a fixed electrode secured within the air-tight space, a movable contact engageable with and separable from the fixed contact is provided to a movable electrode at least partly movable forward and rearward in the air-tight space, a permanent magnet is disposed on a plane intersecting substantially at right angles a direction in which the both contacts engaging and separating, and a yoke is provided to outernally surround the permanent magnet, wherein means at least partly expansible for air-tightly holding the movable electrode and simultaneously allowing positively the movable electrode moved forward and rearward is provided.

Other objects and advantages of the present invention shall be made clear in following description of the invention detailed with reference to embodiments shown in accompanying drawings.

Figure 2:
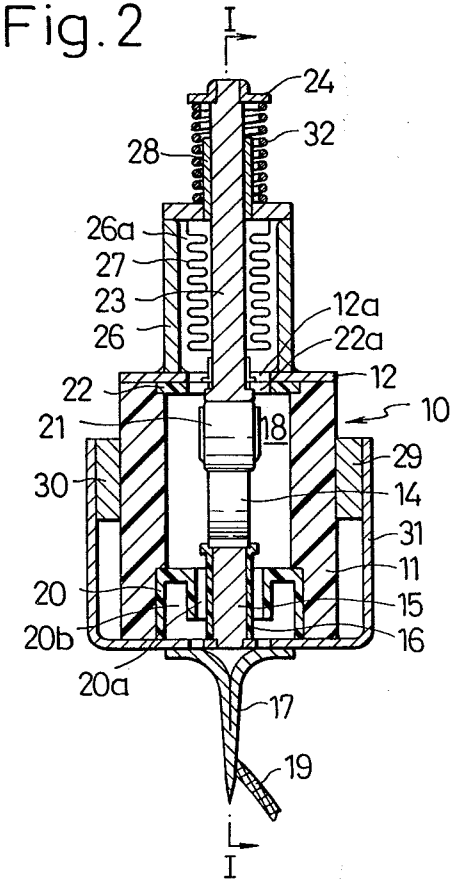
FIG. 2 is also a sectioned view of the device of FIG. 1, taken along line II—II in FIG. 1.
Figure 1:
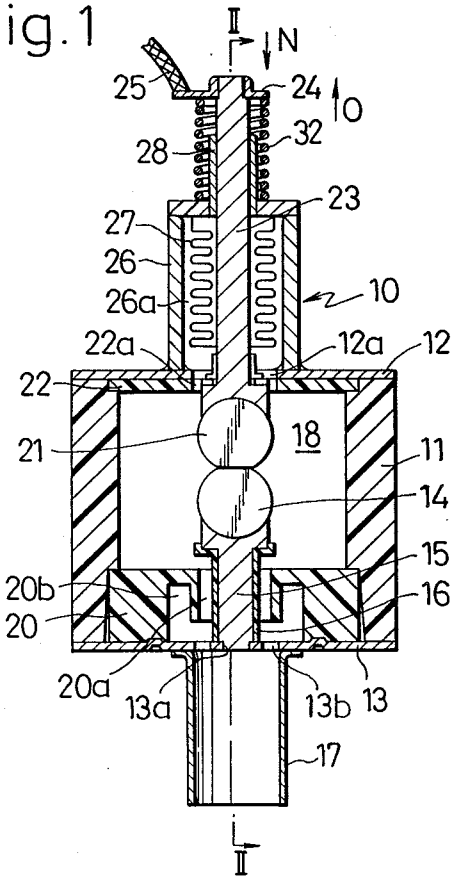
FIG. 1 is a sectioned view of the sealed contact device in an embodiment of the present invention, taken along line I—I in FIG. 2.

DISCLOSURE OF PREFERRED EMBODIMENT:

Referring to FIGS. 1 and 2, there is shown a sealed contact device 10 in an embodiment of the present invention, in which the device 10 comprises a generally cylindrical barrel part 11 formed by such an electrically insulating material as ceramics, and end plates 12 and 13 made of such metallic material as oxygen free copper, 42 alloy or the like and respectively fitted to each of both axial open ends of the barrel part 11, and these barrel part 11 and end plates 12 and 13 are forming a hermetical container. In the center of the lower end plate 13, a fitting hole 13*a* is made, and a fixed shaft 15 to the upper end of which a fixed contact 14 is secured is disposed within the barrel part 11 and fitted at a base end of the fixed shaft 15 into the hole 13*a*. The fixed contact 14 is formed by a metal material substantially into a disk shape except for a flattened part at a circumferential periphery to be a top surface of the fixed contact 14. The fixed shaft 15 also made of the metallic material is covered by an insulating sleeve 16 made of such insulating material as ceramics, and a fixed electrode is formed by these fixed contact 14 and shaft 15.

To the lower end plate 13, further, a gas tube 17 is secured externally so that such electrically insulating gas high in the thermal conductivity as hydrogen gas, a mixture gas of hydrogen and nitrogen gases or the like is sealed in the hermetical container through small holes 13*b* made around the center hole 13*a*, after an air-tight space 18 is defined therein, under such a pressure higher than the atmospheric pressure as 2 to 3 atm. and, after the gas sealing, the gas tube 17 is crushingly compressed to seal the small holes 13*b*, as seen in FIG. 2, for retaining the air-tightness of the space 18, and also to form a connecting terminal for a connecting wire 19 after being compressed. Inside the end plate 13, further, an insulating member 20 made of such insulating material as ceramics and having an axial through hole 20*a* for passing therethrough the fixed shaft 15 is mounted to the lower end of the barrel part 11, with outer periphery engaged to the part 11, while defining a downward recess 20*b* continuing to the through hole 20*a*.

Within the air-tight space 18, further, a movable contact 21 engageable with and separable from the fixed contact 14 is disposed, an insulating plate 22 of the same material as the insulating member 20 is secured to interior side of the upper end plate 12, and the fixed and movable contacts 14 and 21 in the air-tight space 18 are thus disposed in an insulated chamber enclosed by the barrel part 11, insulating member 20 and insulating plate 22. The movable contact 21 is secured to an end of a movable shaft 23 movable toward and away from the air-tight space 18 as passed through holes 12*a* and 22*a* made respectively in each of the end plate 12 and insulating plate 22. These movable contact 21 and shaft 23 are also made by such metallic material as the oxygen free copper, copper alloy or the like, and are forming a movable electrode. The movable contact 21 is also formed substantially into a disk shape, while thin plate members 21*a* and 21*b* of such insulating material as ceramics are provided to both flat faces. A downward peripheral part of the movable contact 21 is also flattened for contact with the flattened face of the fixed contact 14. Either one of the flattened face of the fixed and movable contacts 14 and 21 may be omitted, but in all events the both contacts 14 and 21 should be formed to realize a line contact rather than a point contact. To the other end of the movable shaft 23, a terminal member 24 is secured, and a connecting wire 25 is connected to this terminal member 24. On the outer face of the upper end plate 12, a holding cylinder 26 of a reverse bottomed shape having an interior chamber 26*a* for passing therethrough the movable shaft 23 is secured at lower open end to outer peripheral part of the through hole 12*a* of the plate 12, and a bellows 27 of a metal tube made of, for example, three thin Ni-Cu-Ni layers and corrugated is housed within the holding cylinder 26. An end of this bellows 27 is secured to a lower portion of the movable shaft 23 adjacent the movable contact 21, and the other upper end of the bellows 27 is secured to the inner upper end face of the cylinder 26. A guide sleeve 28 is externally secured to the upper end of the cylinder 26 peripherally about a center hole in the upper end, and the upper portion of the movable shaft 23 passed through the holding cylinder 26 is guided through the cylinder 26 and projected thereout. With this arrangement of the holding cylinder 26 and bellows 27, the air-tightness of the air-tight space 18 is sufficiently maintained, while the movable shaft 23 is made movable toward and away from the space 18 in an air-tight manner.

At a pair of outer opposing parts on the side face of the barrel part 11, a paid of permanent magnets 29 and 30 are secured to the barrel part 11, and a pair of yoke arms 31 are provided as extended upward from the lower end plate 13 to hold the magnets against the barrel part 11. These permanent magnets 29 and 30 are disposed on a plane intersecting substantially at right angles the direction in which the movable contact 21 moves to make and break the contacts with respect to the fixed contact 14 and substantially at the same level as engaging position of the fixed and movable contacts 14 and 21. Further, a resilient member 32 is provided between the upper end wall of the holding cylinder 26 and the terminal member 24, to bias the movable electrode 23 in separating direction from the fixed electrode 15. In the present instance, the resilient member 32 comprises a compression coil spring made of, for example, phosphor bronze and is mounted about the movable shaft 23.

The operation of the sealed contact device 10 according to the present invention shall be explained next. As the movable shaft 23 is urged by any suitable means to move in a direction shown by an arrow N in FIG. 1, the movable contact 21 is urged to engage the fixed contact 14 to make the contacts closed. When such urging force to the movable shaft 23 is released, a composite force of the insulating gas pressure in the air-tight space 18 and applied to the outer face of the bellows 27 and of the biasing force of the resilient member 32 is applied to the movable shaft 23 in a direction of an arrow 0 in FIG. 1, the movable contact 21 is thereby moved away from the fixed contact 14 to break the contacts open.

While an arc is generated upon the contact opening, this arc is subjected to a quick cooling provided by cooling ability of such insulating gas as hydrogen gas sealed in the space 18 at a high pressure, upon which a magnetic force of the permanent magnets 29 and 30 acting with respect to the contact engaging part is made effective to perform a magnetic blow-out with respect to the arc so as to suppress it within a shorter time. The thin insulating, plates 21*a* and 21*b* on the side faces of the movable contact 21 are effective in this event to prevent the generated arc from shifting peripherally about the movable contact 21, and the line contact achieved between the fixed and movable contacts 14 and 21 is also effective to prevent the electric current from being concentrated to one point so as not to increase the current density. With these technical features, a long life of the contacts can be attained.

Figure 4:
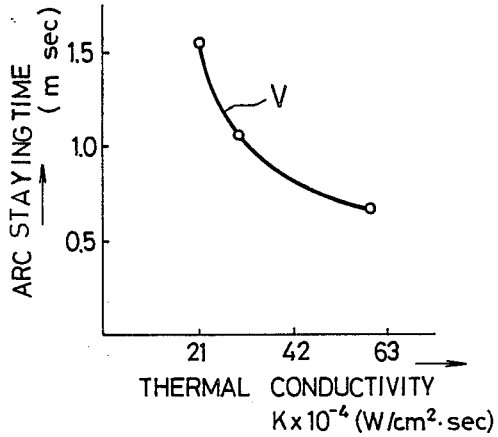
FIG. 4 is a diagram showing the relationship between the electrically insulative gas and the arc staying time in the device of FIG. 1.
Figure 5:
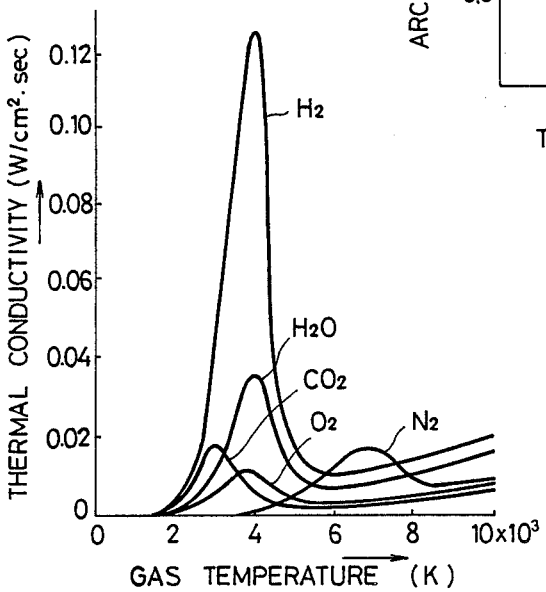
FIG. 5 is a diagram showing the relationship between various gases employable in the device of FIG. 1 and the thermal conductivity.

Referring more specifically to the above, it has been found empirically that following matter is required for the electrically insulating gas sealed in the air-tight space 18. First, the relationship between the thermal conductivity of the gas and the arc staying time has been experimentally observed, with a variety of mixing ratio of argon Ar and helium He while varying the thermal conductivity of the gas. That is, when argon ratio at 0° C. was selected to be 50%, 25% and 0%, the gas thermal conductivity was $20.6\times10^{-4}$, $32.8\times10^{-4}$ and $58.4\times10^{-4}$ ($W/cm^2 sec$). The arc staying time was measured with a current of 3KA passed through the both contacts 14 and 21 (at a peak value of half wave of commercial AC), electrode opening time of 0.94 m.sec. and required time of the movable contact 21 for shifting 2 mm set to be 0.43 m.sec., results of which are as shown in the diagram of FIG. 4 where the thermal conductivity of the gas is taken on the abscissa and the arc staying time is on the ordinate. As will be clear from the diagram, the arc staying time is shortened more as the gas thermal conductivity increases, as represented by a curve V, in view of which it has been found that the higher thermal conductivity of the gas is effective to have the arc suppression carried out at a higher rate and is contributive to a high speed cooling. Next, the thermal conductivities of a variety of the electrically insulating gases are as shown in the diagram of FIG. 5 where the gas temperature is taken on the abscissa and the gas thermal conductivity is on the ordinate. As will be clear from the diagram, the use in particular of hydrogen gas should allow the cooling force for the arc to be strong, when arc temperature is taken into consideration.

Figure 6:
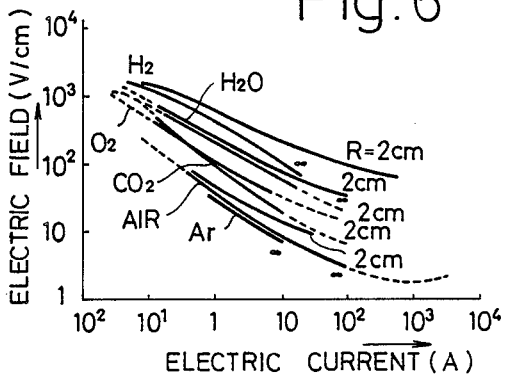
FIG. 6 is a diagram showing the relationship between the electric current and the electric field of positive column of arc in the various gases at atmospheric pressure.

Further, the arc voltages of the various insulating gases are as shown in the diagram of FIG. 6 where the current of positive column of arc is taken on the abscissa and the electric field strength also of the positive column of arc is taken on the ordinate while a radius R of a tube in which the positive column of arc is present is set to be R =2 cm. It has been found from the diagram that, among the various gases, hydrogen gas is again optimum in having a high electric field (V/cm) which is proportional to the gas pressure, so as to be able to comparable to the high arc voltage. While it has been thus found that the hydrogen gas is high in the arc voltage characteristics on one hand, the dielectric breakdown voltage is lowered on the other hand so that an arc generation within the hydrogen gas will be apt to show an arc-over. With an addition of, for example, nitrogen gas $N_2$ to an extent not exceeding 40% by volume ratio as admixed to the hydrogen gas, however, it is made possible to obtain an excellent arc voltage and to render the dielectric breakdown voltage to be at a level of nitrogen gas $N_2$. For the pressure of the hydrogen gas or the mixture gas to be sealed in the air-tight space 18, it has been empirically clarified that the pressure should preferably be about 2 atm., but the pressure is not required to be limited thereto.

In the foregoing sealed contact device 10, the covering of the fixed shaft 15 by the insulating sleeve 16 is effective to prevent the arc generated upon contact opening from developing over to the surface of the fixed shaft 15 to reach the end plate 13. Further, the provision of the downward open recess 20*b* in the insulating member 20 forming the bottom wall of the air-tight space 18 and continuing to the central through hole 20*a* is effective to increase the surface area of the insulating member 20, so that an excellent electric insulation of the member 20 can be retained even when powdery metal caused to be scattered by arc heat adheres to the member 20.

Figure 3:
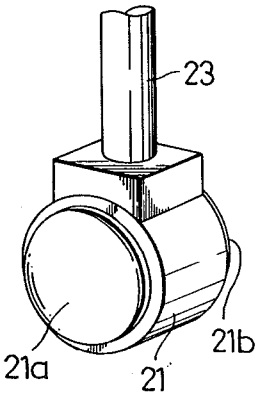
FIG. 3 is a fragmentary perspective view as magnified of the movable electrode and movable contact in the device of FIG. 1.
Figure 9:
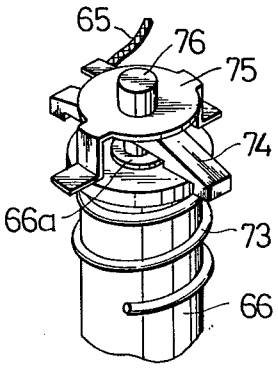
FIG. 9 is a fragmentary perspective view as slightly magnified of a movable electrode in the device of FIG. 7.
Figure 8:
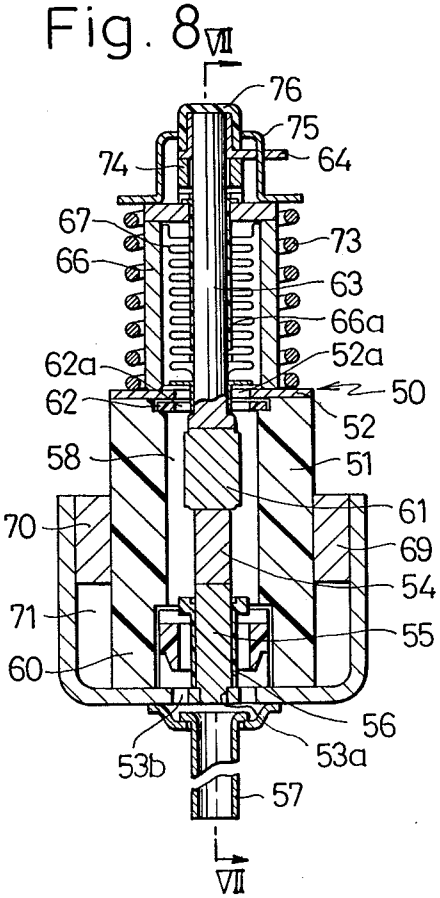
FIG. 8 is a sectioned view of the device of FIG. 7 taken along line VIII—VIII therein.
Figure 7:
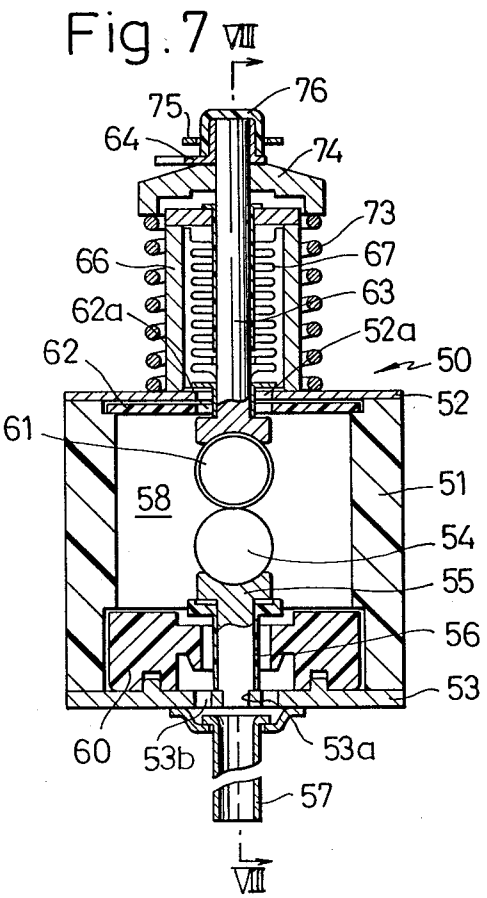
FIG. 7 is a sectioned view of the device in another embodiment of the present invention, taken along line VII—VII in FIG. 8.

Referring next to FIGS. 7–9, there is shown another embodiment according to the present invention, in which the same constituent members as in the embodiment of the sealed contact device 10 shown in FIGS. 1–3 are denoted by the same reference numerals as those in FIGS. 1–3 but added by 40. In the present embodiment, a contact-separating spring 73 is disposed not on the upper end wall of the movable-shaft holding cylinder 66 but rather about the periphery thereof and, optimumly, this spring 73 is selected to be of a height upon non-compression slightly larger than that of the holding cylinder 66. At the other outer end of movable shaft 63 at which a terminal member 64 is secured, a holding arm 74 is mounted rotatably to the shaft 63 to extend in a direction perpendicular to the axis of the shaft, and the spring 73 is compressively held between this arm 74 and an upper end plate 52 of barrel part 51 of the device 50. Adjacent the upper end of the movable shaft 63, a holder 75 reverse U-shaped in side elevation and having a central disk part passing the shaft 63 freely through a central hole in the disk part is disposed as secured at both lower ends of leg parts to the upper end wall of the holding cylinder 66. To the upper end of the movable shaft 63, an end cap 76 is secured to cover the terminal member 64, as passed through the central hole of the holder 75 for rotation with the shaft 63, and this end cap 76 should preferably be formed by such electrically insulating and wear resistant material as Teflon (trademark for a product by Du Pont) or the like, taking into consideration an event where an urging force of a driving means is directly applied thereto as will be detailed later. In this arrangement, the holder 75 is acting to allow the holding arm 74 to attain a constant contact opening and closing stroke of the whole of the movable shaft 63 including up to the end cap 76 covering the terminal member 64, and also to restrain any further movement of the holding arm 74, while the contact-separating spring 73 is restrained by the arm 74 so as not to expand more than predetermined. In the present embodiment, therefore, the required space or length for the contact-separating spring is overlapped on that of the holding cylinder 66, so that the movable shaft 63 can be made shorter and the entire device can be minimized in size, while the axial end of the movable shaft 63 can be strengthened. In the present embodiment, including that a composite force of the pressure of the electrically insulating gas applied to a bellows 67 and of the spring force of the contact-separating spring 73 is applied to the movable shaft 63, other arrangement and operation are the same as those in the embodiment of FIGS. 1–3.

Figure 10:
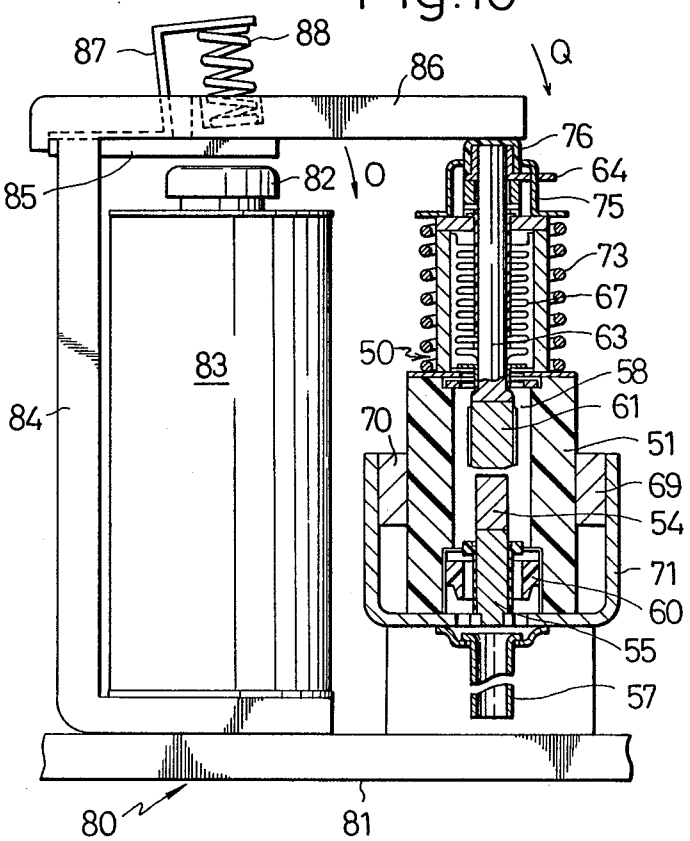
FIG. 10 shows in a side elevation of an arrangement in which the device shown in FIGS. 7 and 8 is associated with a driving means therefor.

The sealed contact device 10 or 50 according to the present invention can be employed as interlocked with such driving means as shown in FIG. 10 in the form of, for example, an electromagnetic device (with the device 50 of FIGS. 7–9 shown just as an example, while the device 10 of FIGS. 1–3 can be equally employed). More specifically, the driving means 80 comprises a mounting base 81, a core 82, a solenoid 83 wound on the core and a yoke 84 which are mounted on the base 81 together with the sealed contact device 50. The yoke 84 is formed substantially in L shape, and an armature 85 is pivotably mounted at an end to upper end part of the yoke 84 so that the other end of the armature will be attracted to upper end of the core 82 when the solenoid 83 is excited. An operating arm 86 is mounted to the armature 85 to be relatively movable to each other so as to interlockingly move with the attracted motion of the armature 85, so that the arm 86 can drive the movable shaft 63 of the device 50 as engaged therewith through the end cap 76, for urging the shaft downward. Here, the operating arm 86 should preferably be formed by such electrically insulating resin material as polycarbonate or the like.

A spring holder 87 secured at an end to the armature 85 disposes the other end of the holder 87 to be above the operating arm 86 as spaced therefrom, and a coil spring 88 is held by the holder 87 as secured at an end to the other end of the holder and engaged at the other end in a recess made preferably in upper face of the operating arm 86, for the interlocking motion of the armature 85 and operating arm 86.

In non-operating state of the driving means 80, as in FIG. 10, the movable electrode formed by the movable shaft 63 and movable contact 61 is subject to the restraint of the holder 75 for not moving further over the predetermined distance, with the contact-separating spring 73 also restrained by the holding arm 74 for providing to the movable electrode the contact separating force in a slightly smaller range than the contact operating stroke, and the movable electrode is urged upward to be separated from the fixed electrode exclusively by the pressure of the electrically insulating gas in the air-tight space 58.

Accompanying the excitation of the solenoid 83 in the drive means 80, on the other hand, the armature 85 and operating arm 86 move downward in the direction of arrows O and Q to urge the movable shaft 63 downward. The force applied to the movable shaft 63 at the initial stage of this downward urging is only of the pressure of the gas sealed in the air-tight space 58 as referred to above, and the movable shaft 63 can be operated even with an initially very slight excitation of the solenoid 83. As the movable shaft 63 is further urged downward, the biasing force of the contact-separating spring 73 is added to the gas pressure, upon which the armature 85 is approaching considerably closely the core 82 and a large attracting force is exerted on the armature, and the movable electrode is smoothly and reliably brought into the contact closing position. It will be readily appreciated here that a sufficient contact pressure is smoothly provided by the spring 88 to the movable electrode in the closing position.

It will be also appreciated that the contact opening of the movable contact 61 with respect to the fixed contact 54 is attained through an operation carried out in opposite manner to the above.

Figure 11:
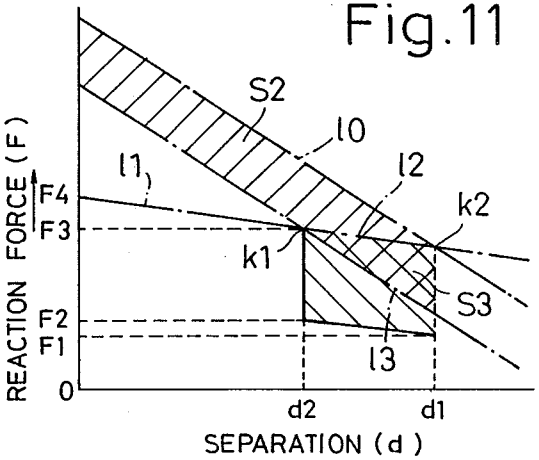
FIG. 11 is a diagram showing the relationship between separating distance of the contacts in the device in the aspect of FIG. 10 and the reaction force.

The operation of the sealed contact device in this case shall be referred to. Referring to FIG. 11 in which the distance of separation between the fixed and movable contacts 54 and 61 is taken on the abscissa and the reaction force applied through the movable shaft 63 to the operating arm 86 is taken on the ordinate, the separation distance d in the opening position of the both contacts is represented by d1 and set to be, for example, 0.75 mm, where the reaction force the operating arm 86 receives is F1. As the solenoid 83 is excited at the position of this reaction force F1, the distance d decreases but the reaction force increases. At a position where the holding arm 74 abuts the upper end of the spring 73, the distance between the both contacts will be d2 while the reaction force be F2 and, immediately thereafter, the biasing force of the spring 73 is added to the insulating gas pressure so that the operating arm 86 will receive a larger reaction force F3, the latter of which increasing until the distance d becomes zero to be the largest reaction force F4 exerted upon the contact closing. Thus, the reaction force will be as shown by a chain line l1. Provided that the contact separating spring 73 is absent, on the other hand, the reaction force will be as represented by a chain line l2 which is an extension of a line connecting F4 point and k1 point for the force F3, a magnetic force required for this event will be as a chain line l0 passing through a point k2 on the line l2, so that a magnetic energy shown by a double-hatched triangular zone S3 may be omitted at initial stage of the contact closing operation.

The electromagnetic force required for the entire operation of the device 50 is denoted by a chain line l3 passing the point k1 and parallel to the line l0. As a whole, the electromagnetic force corresponding to a zone S2 shown as hatched can be saved and, accordingly, the driving means 80 can be minimized in size.

Observing now the operation of the device 50 of the present invention from a different viewpoint, with assumptions that the sealed-in gas pressure at a temperature T0(K) is P (kg/cm$^2$, where $P>1$, here $P=1$ being the atmospheric pressure), required force for opening the contact is F(kgf), pressure receiving area of the bellows 67 in the absence of the contact-separating spring is Sl (cm$^2$), the pressure receiving area of the bellows 67 in the device 50 is S21 (cm$^2$), biasing force of the contact-separating spring 73 is f, and an equal contact separating force F is to be obtained in both cases irrespective of the presence or absence of the spring 73, then a following formula is satisfied:

$$F = (P-1)S1 = (P-1)S21 + f \quad (1)$$

where $(P-1)$ is a pressure difference of the gas in the hermetical container from the atmospheric pressure and denotes the gas pressure applied to the bellows 67.

In order to obtain the same contact separating force F, therefore, the pressure receiving area S21 of the bellows 67 employed in the sealed contact device 50 in the present embodiment may be made smaller by a component for the contact separating spring force f, than the area S1 in the absence of the spring 73, and the bellows 67 as well as the entire device 50 can be minimized in size to be able to reduce costs for manufacturing the device, as will be readily appreciated.

Assuming next that the contact separating force taking place at a temperature T1 (K) is F1 in the absence of the contact-separating spring 73, and is F21 in the device 50, then the F1 in the absence of the spring 73 will be $$F1 = \{(T1/T0)(P-1)\}S1 \quad (2)$$

and a variation ΔF1 of the separating force F1 at a temperature variation (T0 to T1) will be, from the foregoing formulas (1) and (2), $$\Delta F1 = F1 - F = \{(T1/T0) - 1)(P-1)\ S1 \quad (3)$$

In the device 50, on the other hand, $$F21 = \{(T1/T0)(P-1)S21\} + f \quad (4)$$

Similarly, $$F21 = F21 - F = \{(T1/T0) - 1\}(P-1)\ S21 \quad (5)$$

Therefore, assuming that the same temperature variation exists, the variation of the separating force in the device 50 will be, as compared with the case of the absence of the spring 73, smaller by $$\{(T1/T0) - 1\}f \quad (6)$$

Denoting the above with concrete figures inserted, at a temperature of 293K (=20° C.), the sealed-in gas pressure $P = 2(kgf/cm^2)$, required separating force $F = 0.2$ (kgf), spring force of the spring 73 $f = 0.1$ (kgf), then the pressure receiving area S1 of the bellows in the absence of the spring 73 will be 0.2 $cm^2$ while the pressure receiving area S21 of the bellows 67 in the device 50 will be 0.2 $cm^2$, and it becomes suffice the purpose even by setting the pressure receiving area to be $\frac{1}{2}$.

Any variation in the separating force F upon a temperature variation from T0 =293K (=20° C.) to T1=373K (=100° C.) will be from 0.2 kgf to 0.255 kgf in the absence of the spring 73, but will be from 0.2 kgf to 0.227 kgf in the device 50. That is, with the device 50, 28 gf variation is small and an operation stable against any temperature change can be realized. That is, even in the presence of an abnormal increase in the separating force due to a temperature rise, the contacts can be reliably closed.

In the sealed contact device 50 of the present invention, the separating force F will not become zero even when the sealed-in gas pressure is $P = 1$, that is, even in an event where the sealed-in gas has entirely leaked, but the biasing force f of the separating spring 73 is always present so that the device will be still operable, and the reliability of the device can be remarkably improved.

Figure 12:
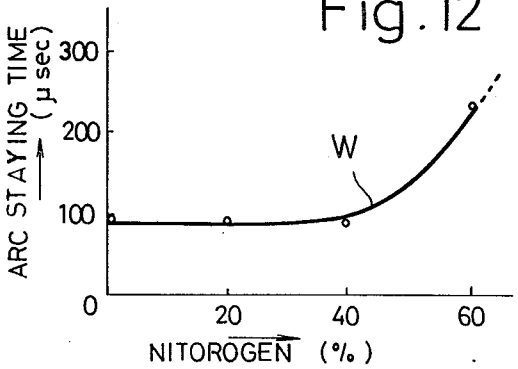
FIG. 12 is a diagram showing the relationship between nitrogen ratio and the arc staying time in the device of FIG. 10.

In the foregoings, the electrically insulating gas has been referred to as being preferably hydrogen gas or its mixture with nitrogen gas of less than 40% by volume, and its sealed-in pressure has been described to be optimumly 1–10 atm. (absolute pressure). Regarding the former, as will be clear from FIG. 12 in which the mixing ratio of nitrogen is taken on the abscissa while the arc staying time is taken on the ordinate to represent with a curve W a variation in the arc staying time depending on the nitrogen mixture ratio, a nitrogen mixture of more than 40% causes the arc staying time to be abruptly increased. The longer the arc staying time is, the more the contact consumption takes place, of course, and the withstand voltage characteristics of the contacts are caused to be deteriorated to a large extent. Regarding the sealed-in gas pressure, the higher the pressure is than 1 atm., the more the arc transfer is promoted, but the pressure exceeding 10 atm. causes a problem to arise in respect of the pressure resisting properties of the bellows 67 or its environment, as has been made known empirically.

Figure 13:
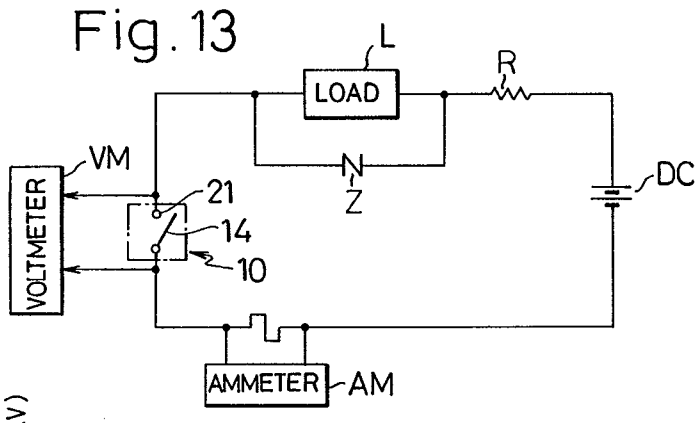
FIG. 13 is a diagram showing an experimentary circuit employable for the sealed contact device according to the present invention.
Figure 14:
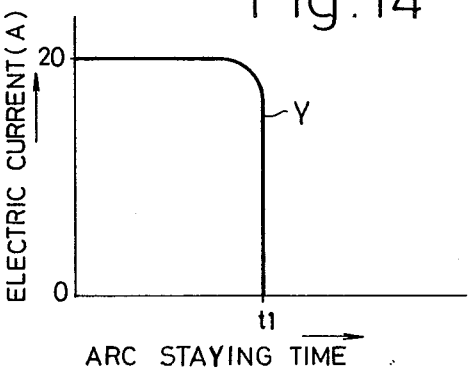
FIG. 14 is a diagram showing the relationship between the arc staying time and the electric current in an experiment made with the device of FIG. 10.
Figure 15:
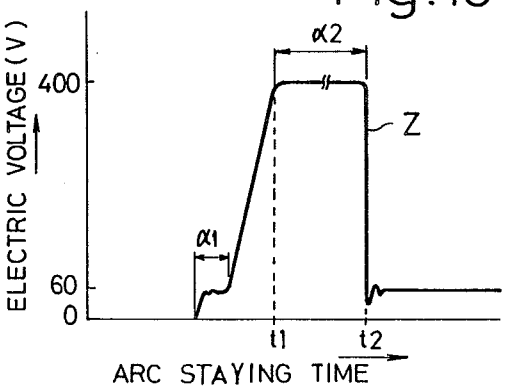
FIG. 15 is a diagram also showing the relationship between the arc staying time and the electric voltage.

While it has been found, in addition, that the fixed and movable contacts made substantially into a disk shape are effective to act as a so-called arc horn with the circular periphery of the disk shape so that the arc can be smoothly transferred to reduce the wear of the contacts, it has been also found empirically that a use of tungsten W as the contact material is practically effective. For this experiment, there has been employed a circuit as shown in FIG. 13, in which a protective resistor R, direct current source DC, current measuring means A and the fixed and movable electrodes including the fixed and movable contacts 14 and 21 of the device 10 according to the present invention are connected in series to a parallel circuit of a load L and surge absorbing circuit Z, and a voltage measuring means VM is connected to the both electrodes. In this circuit arrangement, the device 10 was operated to have the contact opening and closing operations carried out, and the relationship between the current and voltage upon the contact opening and closing and the arc staying time were measured. As the load L, practically, a DC motor of 200V and 20A was utilized, and the lower limit value of deterioration in the contact withstand voltage was set to be an alternating current of 2KV. Results of these experimental measurements are shown by curves Y and Z respectively in FIGS. 14 and 15, in which the current is taken on the ordinate in FIG. 14 and the voltage is on the ordinate of FIG. 15 while the arc staying time is taken on the abscissa in both drawings. As seen in FIG. 14, the current is made immediately to be 0A at breaking time point tl, whereas, as seen in FIG. 15, the arc voltage reaches about 30V in an arc staying time $\alpha 1$ and thereafter the maximum arc voltage (e.g. 400V) at the time point t1, and the voltage across the contacts attenuates to a level of the source voltage after a further staying time $\alpha 2$ (e.g. 2 ms). In FIG. 15, a portion of the curve Z up to the time point t1 is of the arc voltage, a portion from t1 to t2 (the latter being attenuation initiating point) is of a voltage denoted by Znr, and the rest portion following t2 is of the source voltage.

Figure 16:
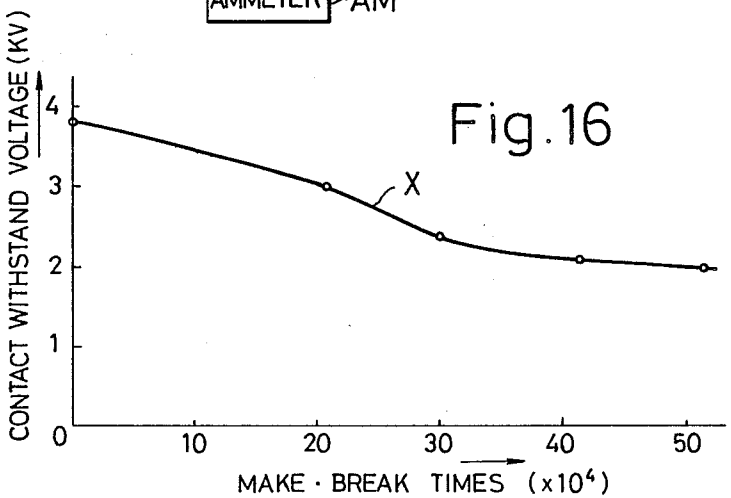
FIG. 16 is a diagram showing the relationship between the number of contact make and break times and the contact withstand voltage in the device in the stage of being used as in FIG. 11. While the present invention shall now be detailed with reference to the embodiments shown in the accompanying drawings, it should be appreciated that the intention is not to limit the invention only to such embodiments shown, but rather to include all modifications, alterations and equivalent arrangements possible within the scope of appended claims.

Another experiment has been carried out to determine, as shown in FIG. 16, the relationship between the number of contact make and break times (on the abscissa) and the contact withstand voltage (on the ordinate) in the device according to the present invention, and it has been found that, as denoted by a curve X, the contact make and break could have been carried out more than 500,000 times until the set lower limit value of 2KV of the contact withstand voltage deterioration was reached.

What we claim as our invention is:

1. A sealed contact device comprising a hermetical container having in its interior an air-tight space in which an electrically insulating gas is sealed, a fixed electrode secured in said air-tight space of said container and having a fixed contact, a movable electrode disposed at least partly in said air-tight space to be movable forward and rearward in air-tight manner and having a movable contact engageable and disengageable with said fixed contact, a permanent magnet disposed in a plane intersecting substantially at right angles a direction in which said contacts open and close, a yoke externally enclosing said permanent magnet, and means at least partly expansible and coupled to said movable electrode for allowing it to be positively movable in said air-tight manner.

2. A device according to claim 1, wherein said means for allowing said movable electrode positively movable comprises means disposed with respect to said movable electrode for biasing it in a direction of separating said movable contact from said fixed contact.

3. A device according to claim 2, wherein said biasing means is a coil-shaped compression spring mounted onto an end part of said movable electrode projecting out of said hermetical container.

4. A device according to claim 1, wherein said electrically insulating gas contains at least hydrogen gas.

5. A device according to claim 4, wherein said electrically insulating gas is a mixture of said hydrogen gas with nitrogen gas.

6. A device according to claim 5, wherein said nitrogen gas is less than 40% by volume.

7. A device according to claim 1, wherein said electrically insulating gas is sealed in said container at a pressure in a range of 1 to 10 atm. in the absolute pressure.

8. A device according to claim 2, which further comprises means for restraining a range in which said biasing means biases said movable electrode in said separating direction to be smaller than a contact opening and closing stroke of said movable electrode.

9. A device according to claim 1, wherein said movable and fixed contacts are formed by a tungsten material.

10. A device according to claim 1, wherein said movable and fixed contacts are formed in a disk shape.

11. A device according to claim 10, wherein at least one of said fixed and movable contacts is provided with a flattened part for realizing a line contact between the both contacts.

* * * * *